United States Patent [19]

Morino et al.

[11] Patent Number: 4,641,626

[45] Date of Patent: Feb. 10, 1987

[54] ELECTRONIC IGNITION DEVICE FOR INTERVAL COMBUSTION ENGINES

[75] Inventors: Seiji Morino, Okazaki; Eiichi Uno, Toyota; Yoshihiro Yoshitani, Kariya, all of Japan

[73] Assignee: Nippondenso Co., Ltd., Kariya, Japan

[21] Appl. No.: 801,227

[22] Filed: Nov. 25, 1985

[30] Foreign Application Priority Data

Nov. 26, 1984 [JP] Japan ..... 59-249895
Jun. 24, 1985 [JP] Japan ..... 60-137151

[51] Int. Cl.[4] ..... F02P 3/02

[52] U.S. Cl. ..... 123/620; 123/621; 123/622

[58] Field of Search ..... 123/620, 621, 622, 634, 123/655; 315/209 T, 209 CD, 209 SC

[56] References Cited

U.S. PATENT DOCUMENTS 1,585,402 5/1926 Mallony ..... 123/622
3,280,809 10/1966 Issler ..... 123/620
3,331,362 7/1967 Mitchell ..... 123/621
4,448,182 5/1984 Aoyama et al. ..... 123/621

FOREIGN PATENT DOCUMENTS 54-7030 1/1979 Japan ..... 123/620
55-98671 7/1980 Japan ..... 123/620

*Primary Examiner*—Raymond A. Nelli
*Attorney, Agent, or Firm*—Cushman, Darby & Cushman

[57] ABSTRACT

A current-interrupting type ignition device having an ignition coil having a primary winding, a secondary winding and an auxiliary winding disposed in the primary circuit, the number of turns of the auxiliary winding being less than that of the primary one. The auxiliary winding is energized in such a manner that electromagnetic flux passes in a direction opposite to that of the primary winding when energized. In this arrangement current flows through the auxiliary winding via a transistor and a diode when the primary current flowing through the primary winding is interrupted, thereby adding a voltage induced across the secondary winding by the transferring effect upon the energization of the auxiliary winding to the corresponding high voltage induced across the secondary winding upon the interruption of the current flow through the primary winding.

12 Claims, 14 Drawing Figures

ELECTRONIC IGNITION DEVICE FOR INTERVAL COMBUSTION ENGINES

FIELD OF THE INVENTION

This invention relates to an electronic ignition device for internal combustion engines, and in particular to an ignition device which induces a large electromotive force across the secondary winding of an ignition coil.

DESCRIPTION OF THE PRIOR ART

Various attempts have been made to improve ignition devices, especially, of the type fitted to "lean-burn" engines, by providing a large electromotive force to reduce both the fuel consumption of the engine and the amount of the pollutants in the exhaust gases.

Typically, the majority of internal combustion engines are fitted with the current-interrupting type of electronic ignition device. In this conventional type of device, the magnitude of the sparking energy is determined by the energy of electromagnetic flux stored in the fields surrounding the core of the ignition coil produced by current flowing through the primary winding of the coil. A major disadvantage of this ignition device is that a relatively large core is necessary so that the number of turns of the primary coil or current flowing therethrough is increased. This is required to create a large electromotive energy across the secondary winding of the coil. However, the increased size of the core increases the size of the device.

A Japanese laid open unexamined patent application No. 55-98671 discloses an ignition system in which a d-c to d-c converter is additionally utilized to induce a high power across the secondary winding of the coil. Also U.S. Pat. No. 3,280,809 discloses an ignition arrangement for internal combustion engines in which two separate ignition transformers include primary windings and secondary windings connected to a distributor through decoupling diodes. The above-mentioned application and patent have disadvantages in that expensive high voltage diodes are indispensable and the dimensions of the devices are large, resulting in an increased manufacturing cost thereof. The '809 patent also discloses, as one of the embodiments, an ignition arrangement in which a capacitive discharge ignition device and a current-interrupting type ignition device are coupled together in the primary circuit. This, however, has the same disadvantages as mentioned before.

Other attempts have been made, in a Japanese laid-open, unexamined patent application No. 54-7030, to obtain a large voltage impulse across the secondary winding of the coil by the introduction of four power transistors. Alternately switching on and off pairs of these transistors causes the primary winding of an ignition coil to be alternately energized. The ignition coil is the conventional type with a turns ratio of 1:100. This ignition arrangement yields the advantage that a voltage energy induced when a pair of transistors of the four transistors is rendered non conductive and another voltage energy induced when the other pair of transistors is rendered conductive are added in the secondary circuit to gain a resulting high voltage impulse to be distributed to the spark plugs of the engine. However, this arrangement entails a number of expensive electrical components such as a pair of P-N-P transistors, a pair of N-P-N transistors and two diodes arranged in the primary circuit.

Also the '030 Japanese application employs a conventional 1:100 turns-ratio coil. If the turns ratio is as high as 1 to 200, the number of turns in the second winding must be increased since the number of turn in the primary winding can be not changed as the input energy is constant, thus causing an increased impedance of the secondary winding. This situation might finally result in the production of a much weaker spark which may be inadequate to ignite the fuel thereby causing mis-firing or otherwise result in a voltage impulse across the secondary winding generated when the ignition coil is energized, thereby unexpectedly igniting the fuel.

An ignition device in the normal ignition system is usually designed to generate a high secondary voltage output well over 2 Kv, considering voltage drops in a distributor circuit including high tension cables respectively connecting the distributor to one of the spark plugs. Here, the absolute minimum secondary voltage necessary for keeping the arc discharge is changed according to engine rotational speed and the loads as well as the battery voltage which is a function of the engine speed and the loads. For the reason stated above, if a generally-used ignition coil, with a turns ratio of 1:100, were utilized in the ignition system disclosed in the aforementioned Japanese patent application No. 54-7030, the secondary voltage generated when one of the two pairs of transistors becomes turned on would be far below the absolute minimum value of 2 Kv, at most about 1.2 Kv. As a result, it is difficult to maintain discharging for a long time with such a low secondary output. Therefore, to make the system work effectively, a transformer with a turns ratio of at least 1 to 200 or 400 between the primary and secondary windings is indispensable. However, such a high turns ratio of the transformer, as described above, may present the problems of high coil impedance and a probability of firing even during the energization of the primary winding.

SUMMARY OF THE INVENTION

It is therefore an object of the invention to provide a compact and a high power ignition device with a cheaper cost, which would be realized with an addition of a simple circuit to a current-interrupting ignition device of the known type.

Another object of the invention is to provide an ignition device which reduces heat generation by interrupting useless current flowing through an auxiliary winding connected to the primary winding in the primary circuit when the arch discharging current of sparking plugs is substantially removed.

Further object of the invention is to provide an ignition device which reduces the heat generation and assure a long life of the sparking plugs, by interrupting current flow through the auxiliary winding more than a predetermined period which is changeable, even when the arc discharging current is still flowing.

Still another object of the invention is to provide an ignition device which reduces the heat generation more effectively and assure a long life of the sparking plugs, by interrupting current flow in the auxiliary winding when the piston passes in time a predetermined cranking angular position near the top dead center, even when the arc discharging current is flowing.

BRIEF DESCRIPTION OF THE DRAWINGS

The above-described and other objects and features of the invention will be described hereinafter in more detail with reference to FIGS. 1 to 13 of the annexed drawings in which.

DESCRIPTION OF THE PREFERRED EMBODIMENT

Hereinafter, an electronic ignition device for internal combustion engines will now be explained in greater detail according to its embodiments with reference to the drawings of FIG. 1 to FIG. 13.

Figure 1:
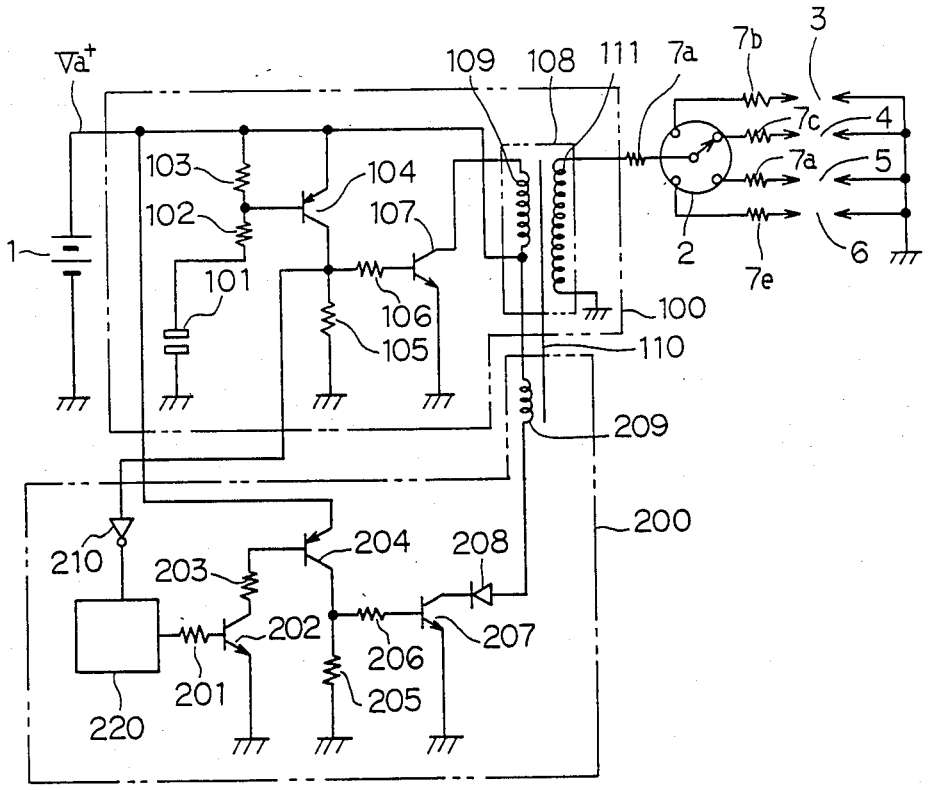
FIG. 1 is a circuit diagram of a first embodiment of the ignition device according to the invention

Referring first to a first embodiment of the invention, in FIG. 1 there is shown an ignition circuit arrangement comprising a battery 1, a current-interrupting type ignition circuit 100 of known type having an ignition coil 108. Secondary winding 111 of coil 108 is grounded at one end. The other end is connected to the respective spark plugs 3 to 6 through a distributor 2 and high tension cables *7a* to *7e* in a predetermined sequence. An electromotive force boosting circuit 200 is connected to ignition circuit 100.

Current-interrupting type ignition circuit 100 includes contact breaker points 101 connected between the negative battery terminal and one resistor 102 of a resistor-bias circuit comprising two resistors 102 and 103 the other end of which is connected to the positive battery terminal. The tapping point of the resistor-bias circuit is connected to the base of a P-N-P transistor 104 the emitter of which is connected to the positive battery terminal. The collector of transistor 104 is grounded through a resistor 105 and also connected to the base of a N-P-N transistor 107 through a resistor 106. The collector and emitter respectively of the transistor 107 are connected to the positive battery terminal through the primary winding 109 and to the ground.

In electromotive force boosting circuit 200, an inverter 210 of which the input is connected to the collector of the transistor 104 is connected at its output side to a monostable multivibrator 220. The output of the multivibrator 220 is connected through a resistor 201 to the base of a N-P-N transistor 202 the emitter of which is grounded. The collector of transistor 202 is connected to the base of a P-N-P transistor 204 through a resistor 203, the emitter of which is connected to the positive battery terminal. The collector of transistor 204 is grounded through a resistor 205 and also connected to the base of a N-P-N transistor 207 through a resistor 206. The collector of transistor 207 is connected to the positive battery terminal through a series combination of a diode 208 and a primary auxiliary winding 209 such that the cathode of diode 208 is connected to the collector of transistor 207.

It is noted here in FIG. 1 that primary auxiliary winding 209 is wound about an iron core 110 of ignition coil 108, about which primary winding 109 is also wound, in such a manner that the electromagnetic flux passes in a direction opposite to that of primary winding 109. The turns ratio between primary and secondary windings 109 and 111 is about 1 to 100 which is the same turns ratio as is typical. The turns ratio between the primary auxiliary and secondary windings 209 and 111 is about from 1 to 200 to 1 to 400.

In operation, contact breaker point 101 is opened and closed by a cam driven from the engine crank or cam shaft of the engine and in FIG. 1, closure of contact breaker point 101 makes transistors 104 and 107 conductive so that current flows through transistor 107 and hence through primary winding 109 of ignition coil 108. Thereafter, contact breaker point 101 is opened and this causes transistors 104 and 107 to become nonconductive stopping current flow through primary winding 109. The interruption of current flow through primary winding 109 causes the rapid collapse of the magentic field about core 110, inducing a high voltage across secondary winding 111 which is then sequentially distributed through distributor 2 to spark plugs 3 to 6. This causes current to arc across the spark gap of each spark plug.

As soon as contact breaker point 101 opens causing transistor 107 to turn off, inverter 210 produces a pulse applied to multivibrator 220. As a result, multivibrator 220 generates a high level output signal having a predetermined pulse width, about 2 ms in this embodiment, and transistor 207, in turn, switches on during such output signal. In the circuit diode 208 prevents current from flowing through transistor 207 from its emitter electrode to its collector electrode.

Primary auxiliary winding 209, as described above, is wound about iron core 110 in such a manner that the direction of electromagnetic flux generated in iron core 110 by the current flow through primary auxiliary winding 209 when the transistor 207 is conductive, is opposite to the direction of electromagnetic flux generated in iron core 110 by the current flow through primary winding 109 when transistor 107 is conductive. As is well known, since the direction of electromagnetic flux generated with transistor 107 conductive is opposite to that generated when transistor 107 is nonconductive, the electromagnetic flux generated in iron core 110 when primary winding 109 is not energized passes in the same direction as the electromagnetic flux generated in core 110 when primary auxiliary winding 209 is energized. Therefore electromotive forces induced by the energization of primary auxiliary winding 209 adds with the electromotive force induced across secondary winding 111 by the interruption of current flow through primary winding 109.

The magnitude of the voltage impulse generated across secondary winding 111 via primary auxiliary winding 209 may be a function of the battery terminal voltage while an absolute minimum voltage necessary for arc discharge of spark plugs 3 to 6 may change according to the engine speed and the load as described before. However, even if the battery terminal voltage is relatively low, a secondary voltage higher than the absolute minimum voltage is generated because the turns ratio between primary auxiliary winding 209 and secondary winding 111 is adapted to be selected as from 1 to 200 to 1 to 400 which is larger than that provided between primary and secondary windings 109 and 111. Further, primary winding 109 and secondary winding 111 both of known type are able to be used, hence, there will be no problem such as an increased coil impedance or an unexpected firing with primary winding 109 energized.

Hereinafter, the operation of the first embodiment of the invention will be explained in greater detail with reference to FIG. 2. FIG. 2(A) illustrates the waveform of the terminal voltage of the contact breaker point 101 switching "on" and "off" and FIG. 2(B) illustrates the primary winding current waveform. The primary current starts flowing through the primary winding at t0 and stops its flowing at t1 so that the high voltage impulse is simultaneously induced in secondary winding 111 by the sudden collapse of the primary current at t1. The induced voltage is distributed sequentially to spark plugs 3 to 6, allowing the flow of the arc-discharge current as shown in FIG. 2(E).

At this time, the electromagnetic flux passing through iron core 110 varies from Xo to X1 as shown in FIG. 2(F) and an energy corresponding to current flowing through primary winding 109 is stored in iron core 110. In the meantime, multivibrator 220, as shown in FIG. 2(C), generates a high level output from the time t1 for the period of 2 ms, allowing current to flow through primary auxiliary winding 209 for that period as shown in FIG. 2(D). In FIG. 2(D), such current is divided into two components "c" and "e" wherein only "c" contributes to part d of the whole arc-discharge current caused by a boosted voltage across secondary winding 111. After the total electromagnetic flux decreases to zero at t2 as shown in FIG. 2(F), current corresponding to "e" in turn generates an electromagnetic flux in the opposite direction from t2 to t3.

Figure 2:
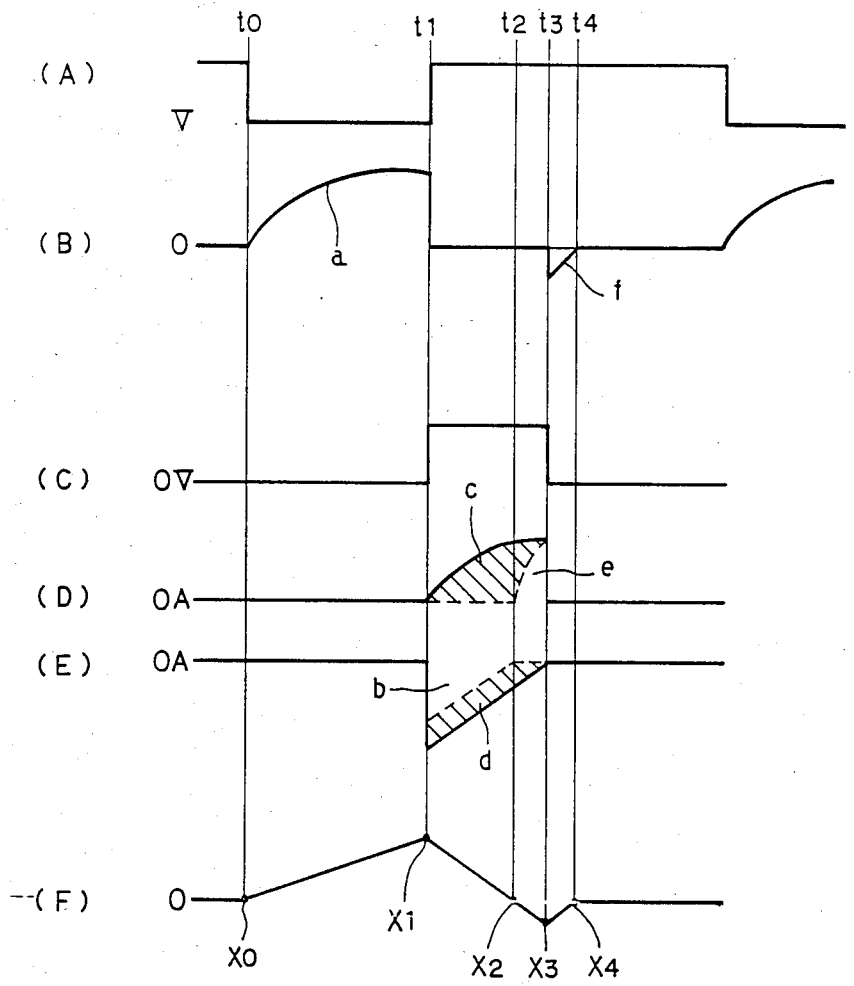
FIGS. 2A through 2F is a signal waveform diagram useful for explaining the operation of the first embodiment shown in FIG. 1.

As shown in FIG. 2(B), the electromagnetic flux stored in iron core 110 from t2 to t3 forms a reverse current "f" flowing via primary winding 109 and transistor 107 and thereafter it becomes "zero". During the period from t2 to t3, the current flowing through primary auxiliary winding 209 remains at a predetermined value while storing electromagnetic flux in iron core 110. The aforementioned period may be adapted to be one half to one fourth the period from t0 to t1 within which the primary winding current reaches a predetermined value, since the number turns of the primary auxiliary winding 209 is one half to one fourth that of primary winding 109 and the auxiliary winding inductance is one-fourth to one-sixteenth primary winding 109. Therefore, time for the primary auxiliary winding current to rise from "zero" to a relatively steady value is one half to one fourth of the time for the primary winding current to reach a relatively steady value. Consequently, the pulse width of the output pulse outputted from multivibrator 220 need not extend beyond the time that the primary auxiliary winding current contributes to the storing of electromagnetic flux, as from t1 to t3 in FIG. 2.

In this invention, the number of turns of primary auxiliary winding 209 is one half to one fourth that of the primary winding 109 and auxiliary winding 209 is wound about iron core 110 in the reverse direction from primary winding 109. Also a simple circuit arrangement comprising transistor 207, diode 208 and multivibrator 220 effectively doubles the voltage output induced in the secondary circuit since the voltage developed across primary auxiliary winding 209 is also multiplied by the turns-ratio between primary winding 109 and primary auxiliary winding 209. Therefore a sufficiently powerful arc discharge of spark plugs 3 to 6 is produced when compared with the obtainable with a conventional ignition device of known type.

Furthermore, although the number of turns of primary auxiliary winding 209 is one half to one fourth that of primary winding 109, transistors 107 and 207 can have the same current rating if a resistance value of primary auxiliary winding 209 is as much as that of primary winding 109 by utilizing a relatively smaller-diameter winding as the auxiliary one.

While, in the above-described embodiment according to this invention, the maximum current flowing through primary auxiliary winding 209 is determined by the aforementioned resistance value thereof, the same effect may be obtained by driving transistor 207 with a constant current circuit. In addition, multivibrator 220 may be arranged to generate a pulse whose width varies in accordance with the engine speed and/or the load amount in order to variably change the shape of the waveform of voltage output induced across secondary winding 111 with time. In this embodiment, electromotive force boosting circuit 200 is adapted to be energized as soon as the engine starts. However, energization of boosting circuit 200 according to the various operational modes of the engine, for example, such as starting, low engine rotational speeds and lesser load, in order to prevent wear of distributor 2 and spark plugs 3 to 6.

Figure 3:
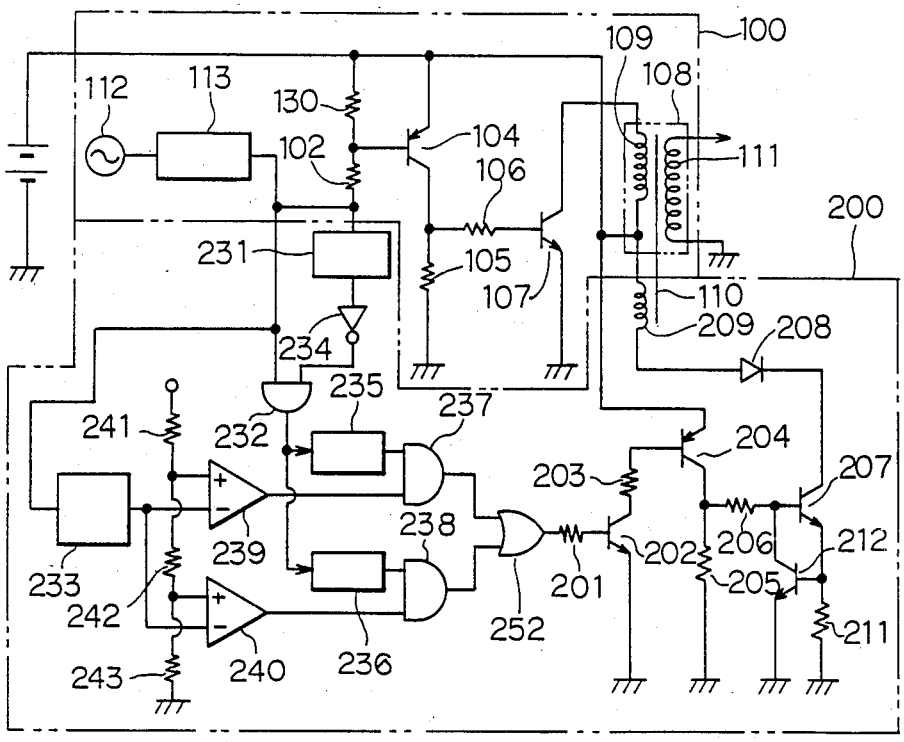
FIG. 3 is a circuit diagram of a second embodiment functioning similarly to that of FIG. 1 but wherein an electromagnetic pickup and a wave-shaping circuit are utilized instead of a breaker point of FIG. 1.
Figure 4:
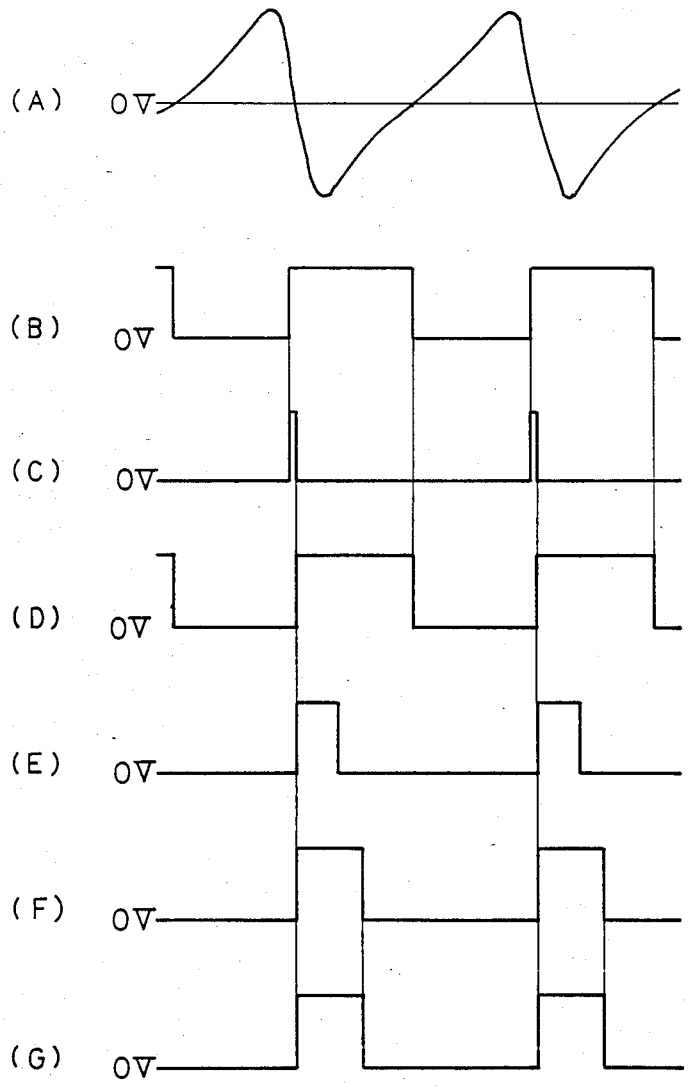
FIGS. 4A through 4G is a voltage-time diagram useful for explaining the operation of the second embodiment shown in FIG. 3.

FIG. 3 illustrates an arrangment as a second embodiment in which the period during which primary auxiliary winding 209 is energized is varied in response to engine speed. Most parts and their connections of current-interrupting ignition circuit 100' are the same as circuit 100 in FIG. 1. However, instead of contact breaker point 101, an electromagnetic pickup 112 is utilized which is connected to a wave-shaping circuit 113, thereby shaping the electromagnetic pickup output signal and applying it to one end of resistor 102 making up together with resistor 103 the resistor-bias circuit for transistor 104. The output of wave-shaping circuit 113 is also connected to a monostable multivibrator 231 and to one of two input terminals of an AND gate 232. The output of multivibrator 231 is connected to the other input terminal of AND gate 232 via inverter 234. The output terminal of AND gate 232 is connected to one of the input terminals of AND gates 237 and 238 via monostable multivibrators 235 and 236.

The output of wave-shaping circuit 113 is further connected to frequency-voltage convertor 233, the output of which is connected to the inverting terminals of comparators 239 and 240. The non-inverting terminals of comparators 239 and 240 are respectively connected to tapping points of series connected resistors 241 to 243 as a potential divider provided between a constant voltage V+ and ground. The outputs of comparators 239 and 240 are respectively connected to the other input terminals of AND gates 237 and 238. The output terminals of gates 237 and 238 are connected to input terminals of OR gate 252 connected to the base electrode of transistor 202 through resistor 201. In this arrangement, current detecting resistor 211 is provided in series between the emitter electrode of transistor 207 and ground and the junction between transistor 207 and resistor 211 is connected to the base electrode of transistor 212 having a collector electrode connected to the junction between transistor 207 and resistor 206, and an emitter electrode connected to ground. When the primary auxiliary current flowing through resistor 211 reaches a predetermined value, transistor 212 turns on, decreasing the amount of base bias current for transistor 207, resulting in constant current regulation to a predetermined value.

The operation of the circuit arrangement described above will be described with reference to FIG. 4. Multivibrator 231, in synchronism with the output signal of waveshaping circuit 113 (FIG. 4C), generates pulse signals having a pulse width of about 50 μs as shown by C in FIG. 4. As electromagnetic pickup 112 generates an alternating output signal as shown by A in FIG. 4, AND gate 232 generates pulse signals as shown by D in FIG. 4. These signals are fed to multivibrators 235 and 236 which, in synchronism with the output signals of AND gate 232, respectively generate high level outputs having pulse widths of about 2 and 3 ms, as shown by E and F in FIG. 4. These high level outputs are respectively fed to input terminals of AND gates 237 and 238.

The output voltage of frequency-voltage convertor 233, which corresponds to engine speed, is fed to the inverting terminals of comparators 239 and 240. By appropriately selecting the relative resistance values of the potential divider, comparator 239 generates a high level output when the engine rotational speed is less than 2,000 r.p.m. and comparator 240 generates a high level output when the engine rotational speed is less than 1,000 r.p.m.. The outputs of comparators 239 and 240, respectively, are fed to the other inputs of AND gates 237 and 238. Therefore, when the engine rotational speed is less than 1,000 r.p.m. OR gate 252 generates the same high level output as multivibrator 236 generates as shown by G in FIG. 4. In the above arrangement, the energization of primary auxiliary winding 209 is controlled such that when the engine rotational speeds are from 0 to 1,000 r.p.m., where ignitability is relatively poor, current flows through the primary auxiliary winding 209 for 3 ms when the primary current is interrupted. When the engine speed ranges from 1,000 to 2,000 r.p.m., where ignitability is relatively fair, current flows therethrough for 2 ms. When the engine rotational speed exceeds 2,000 r.p.m., where the ignitability is relatively good or excellent, no current flows therethrough thereby prohibiting the electrodes of the spark plugs from abrasion.

In the above described example the current flow through primary auxiliary winding 209 has a delay-time of about 50 μs with respect to the interruption of the primary current. Since base-emitter capacitance causes a delay for transistor 107 to be driven from an "on" state to an "off" state, transistor 207 for primary auxiliary winding 209 may be switched on during the delay period of transistor 107, reducing the electromotive force, causing a smaller spark. Therefore, transistor 207 is positively kept non-conductive for a certain period until transistor 107 must be non-conductive.

Figure 5:
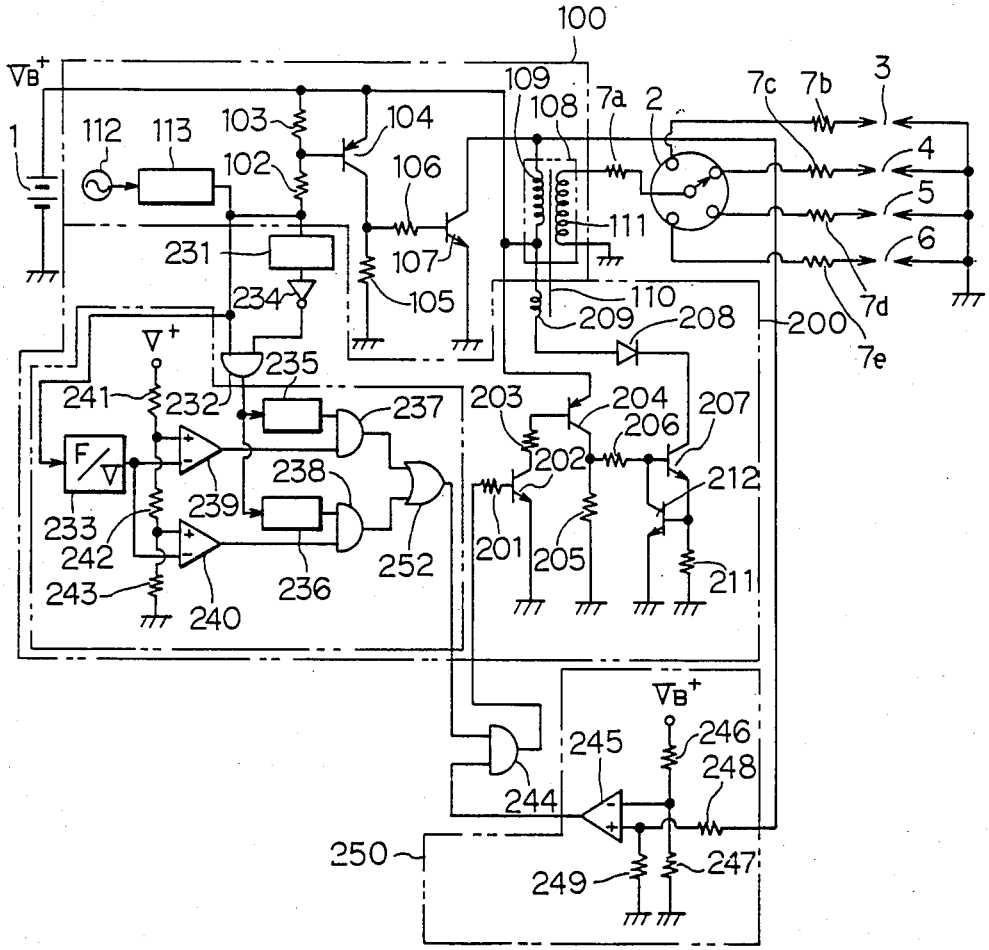
FIG. 5 is a circuit diagram of a third embodiment functioning basically, similarly to that of FIG. 3 but wherein an AND logic circuit and a discharging time detecting circuit are added thereto.

FIG. 5 illustrates another arrangement as a third embodiment in which a discharging time detecting circuit 250 is added which comprises a potential divider having resistors 246 and 247. One end of the divider is connected to the positive terminal of battery 1 and the other end is connected to the negative terminal of battery 1, here, to ground in this embodiment. Resistor 248, connected in series with resistor 249, is connected to the collector electrode of transistor 107 at one end. The tapping point between resistors 246 and 247 is connected to the inverting terminal of a comparator 245 and another tapping point between resistors 248 and 249 is connected to the non-inverting terminal of comparator 245. The output terminal of comparator 245 is connected to one of the inputs of AND gate 244 the other input of which is directly connected to the output terminal of OR gate 252. The output terminal of AND gate 244 is connected to transistor 202 through resistor 201.

Figure 6A:
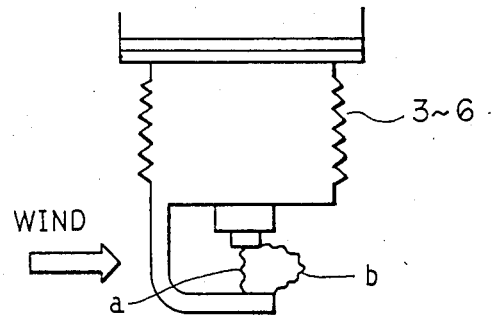
FIG. 6A is an enlarged view of an electrode portion of a sparking plug illustrating two discharging paths.
Figure 6B:
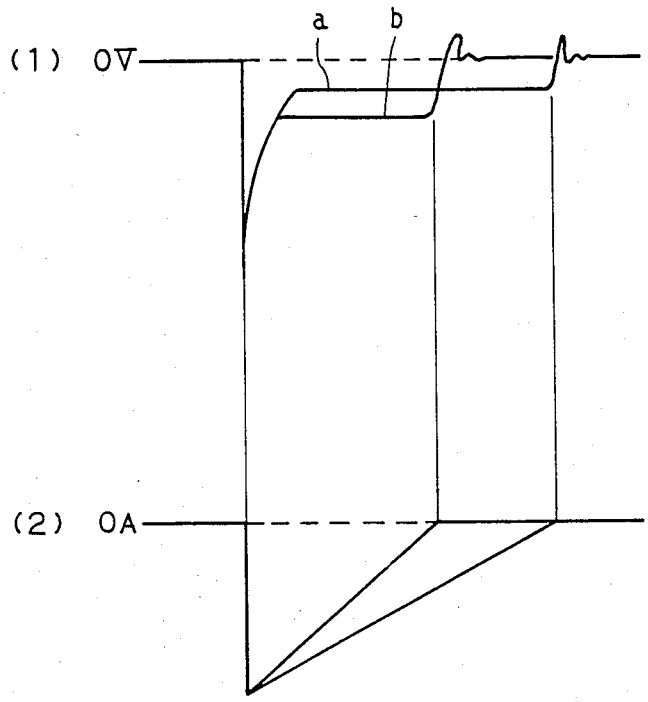
FIG. 6B is voltage-time and current-time diagrams of the respective paths shown in FIG. 6A.

In the third embodiment the magnitude of the electromotive force developed across secondary winding 111 is controlled by controlling the conduction period of transistor 207 in the primary auxiliary winding circuit by changing the pulse width of the variably monostable signal from AND gate 244 in accordance with engine speed. In reality the discharging time always changes as a discharging path changes due to an air current in the cylinder as shown by FIG. 6A.

Figure 7:
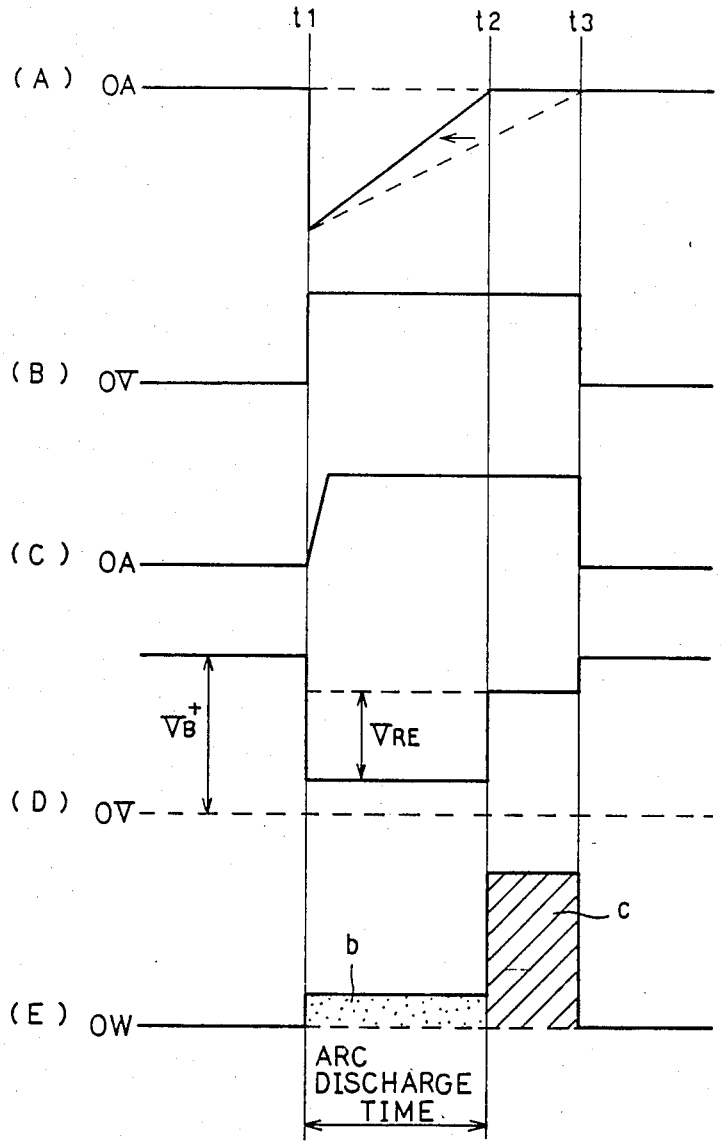
FIGS. 7A through E and 8A through E are signal waveform useful for explaining the operation of the third embodiment shown in FIG. 5.
Figure 8:
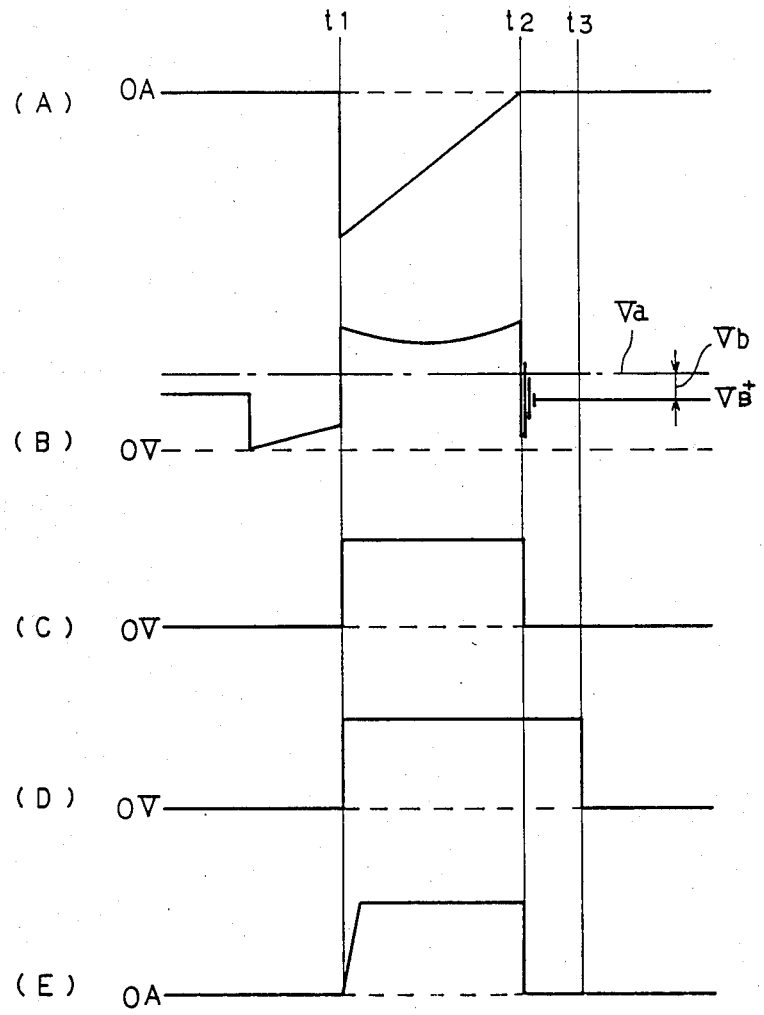

Therefore, if transistor 207 is controlled only by the variable monostable output it may be overheated as explained hereinafter by referring to FIG. 7. When transistor 207 is rendered conductive and when the discharging current, as shown by A in FIG. 7, is flowing from t1 to t2 in time, transistor 207 operates at relatively low power dissipation due to a counterelectromotive force $V_{RE}$ from the secondary circuit as shown by b of FIG. 7E. Assuming that the discharging time becomes shorter due to the above-mentioned air-current than the pulse width of the variable monostable output, time t2 to time t3, no discharging current flows though transistor 207 is conductive. At the same time, the collector terminal voltage of transistor 207 rises up as the counterelectromotive force disappears, thus resulting in increased power dissipation by transistor 207 as shown by c of FIG. 7E. Accordingly, in order to prevent heat damage of transistor 207, in this third arrangement discharging time detecting circuit 250 detects the discharging time of the spark. When the detected discharging time is shorter than the pulse width of the variable monostable output, detecting circuit 250 turn off transistor 207 when the discharging action has been completed.

Next, the method of detecting a discharging time by the discharging time detecting circuit 250 will be described utilizing FIGS. 8A to 8E. When the discharging current flows through each spark plug as shown in FIG. 8A, a relatively high voltage ranging from 30 to 40 volts appears at the collector electrode of transistor 107 as shown in FIG. 8B. By appropriately selecting the relative values of resistors 246 to 248, the output of comparator 245 will be a detected discharging time signal as shown in FIG. 8C.

As seen in FIG. 8B, the positive terminal voltage $V_B+$ of battery 1 is applied to the collector of transistor 107. Therefore, a threshold voltage Va includes a controlling voltage Vb added to the battery terminal voltage $V_B+$. Transistor 207 is energized by an output of AND gate 244 receiving both the detected discharging time signal shown in FIG. 8C and the variable monostable output shown in FIG. 8D. Transistor 207 causes current to pass through primary auxiliary winding 209 as shown in FIG. 8E. As a result of this arrangement, transistor 207 is positively switched off when the discharging action has been completed even if the discharging period from t1 to t2 is shorter than the pulse width of the variable monostable output from t1 to t3, thus protecting transistor 207 from being excessibly heated.

Figure 9:
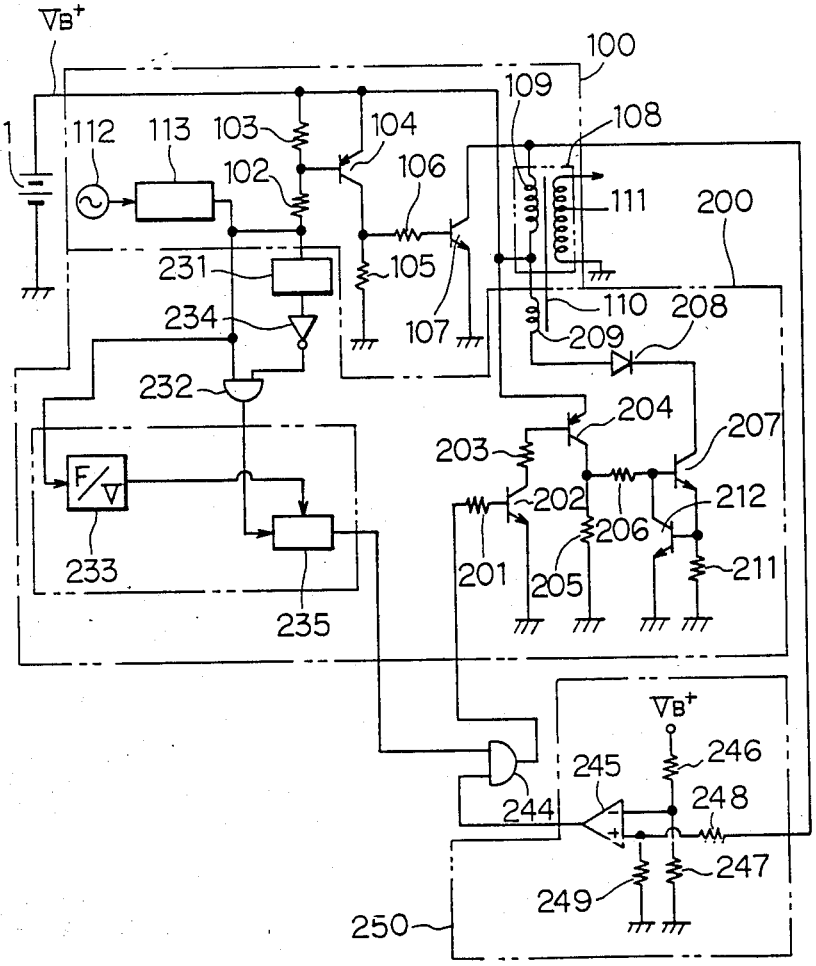
FIGS. 9 and 10 are circuit diagrams respectively showing fourth and fifth embodiments according to the invention, namely FIG. 9 containing a variable monostable multivibrator circuit wherein a period of the variable monostable circuit signal is decreased with an increase in the engine speed, FIG. 10 containing a cranking angular position detecting circuit having a flip-flop instead of the variable monostable multivibrator circuit of the third embodiment shown in FIG. 5.

FIG. 9 illustrates a fourth embodiment which is essentially different from FIG. 5 in that the time constant of monostable multivibrator 235 is continuously changed by voltage values corresponding to engine speeds. The pulse width of the variable monostable output outputted from monostable multivibrator 235 is continuously shortened with an increase in engine speed.

Figure 10:
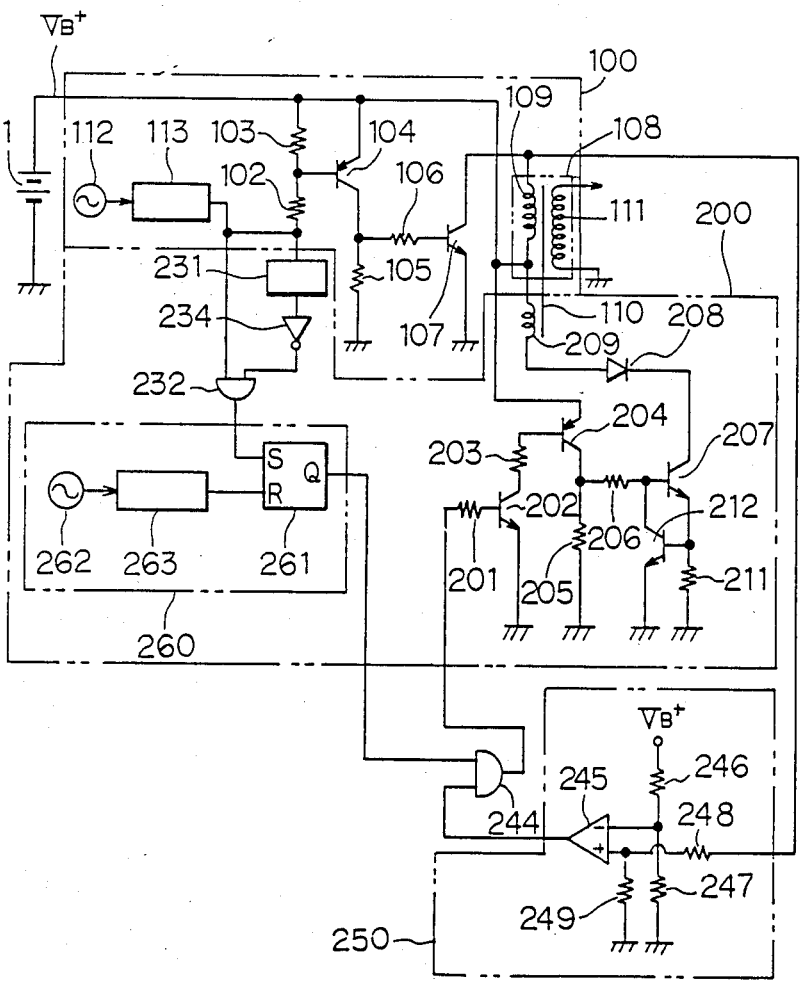

FIG. 10 shows a fifth embodiment which is essentially different from FIG. 9 in that the output of AND gate 232 is connected to the set terminal S of a flip-flop 261. A sensor 262, detecting a cranking angular position near the top dead center is connected via wave-shaping circuit 263 to the reset terminal R of flip-flop 261. The output Q of flip-flop 261 is connected to one of the inputs of AND gate 244. In this arrangement flip-flop 261, sensor 262 and wave-shaping circuit 263 make up a cranking angular position detecting circuit 260. This circuit arrangement, independent of the engine speed, can pass current through primary auxiliary winding 209 from the interruption of current flowing through primary winding 109 to a cranking angular position near the top dead center.

Figure 11:
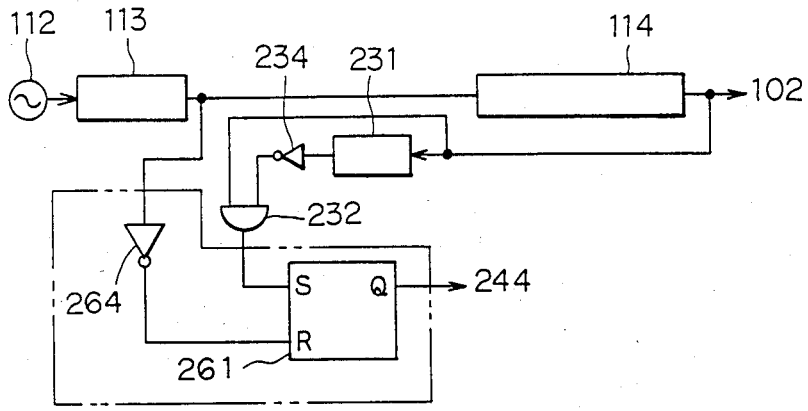
FIGS. 11 and 12 are wiring diagrams respectively showing important parts of sixth and seventh embodiments according to the invention.

FIG. 11 shows a sixth embodiment in which electromagnetic pickup 112 connected to wave-shaping circuit 113 is arranged such that a position at which the output pulses of wave-shaping circuit 113 turn off substantially corresponds to the top dead center in time. The output from wave-shaping circuit 113 is applied to the reset terminal R of flip-flop 261 through invertor 264. The output of circuit 113 is also directly applied to electronic ignition timing control circuit 114 to electronically control an ignition timing and generate the corresponding ignition timing signal, thereby switching on and off the current flow through primary coil 109. Circuit 114 may be any well known circuit to further adjust ignition timing, e.g., in response to engine operating conditions. The ignition timing signal is also supplied to both monostable multivibrator 231 and AND gate 232, the ouput of which is connected, as referred to above in connection with FIG. 10, to the set terminal S of flip-flop 261. The arrangement provides the same function and advantageous results as are referred to in the fifth embodiment, without sensor 262 and wave-shaping circuit 263.

Figure 12:
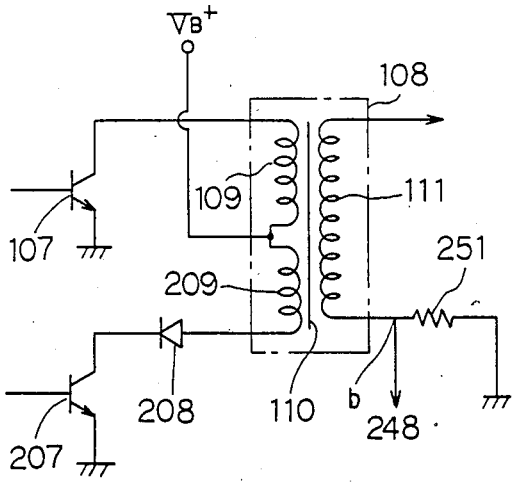

In FIG. 12 is shown a seventh embodiment in which one end of secondary winding 111 is grounded through resistor 251 and the juncture between secondary winding 111 and resistor 241 is connected to resistor 248 of discharging time detecting circuit 250. In this case the discharging current is directly detected by resistor 251.

Figure 13:
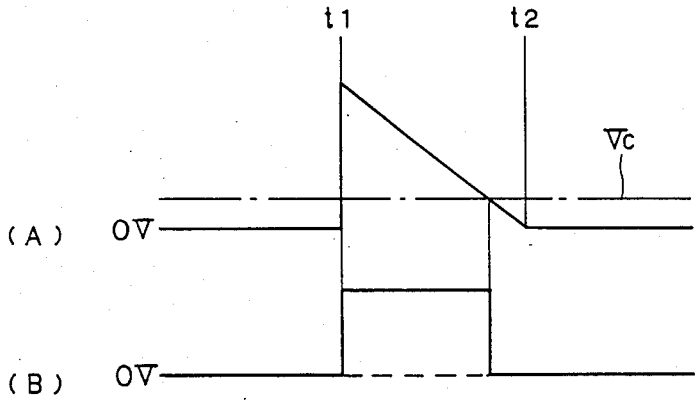
FIGS. 13A and B is voltage-time diagrams useful for explaining the operation of the seventh embodiment of FIG. 12.

FIG. 13 shows voltage-time diagrams for points illustrated in FIG. 12. The solid line of FIG. 13A illustrates the voltage waveform developed across resistor 251, taking the maximum value at t1 or when the primary current of ignition coil 108 is interrupted and thereafter gradually decreased. The dot-dash-line illustrates a predetermined set voltage Vc which takes a relatively low value. In this case when voltage across resistor 251 is higher than Vc a high level discharge detecting signal is outputted from comparator 245 as shown in FIG. 13B.

Although only a few exemplary embodiments of this invention have been described in detail above, those skilled in the art will readily appreciate that many modifications are possible in the preferred embodiments without materially departing from the novel teachings and advantages of this invention. Accordingly, all such modifications are intended to be included within this invention as defined by the following claims.

What we claim is:

1. An electronic ignition device for an internal combustion engine comprising:

an ignition coil having a core and primary and secondary windings, both wound about said core;

first current interrupter means for alternately turning on and off current flow through said primary winding thereby inducing a high voltage across said secondary winding upon the interruption of the current flow through said primary winding;

an auxiliary winding, having less turns than said primary winding, wound about said core of said ignition coil and connected to said primary winding;

second primary interrupter means for completing a current flow path through said auxiliary winding for a certain period upon each interruption of current flowing through said primary winding, said current flow path causing magnetic flux to be generated through said core in a direction opposite to that of magnetic flux generated when said primary winding is energized; and a diode, provided in said current flow path and connected in series with said second current interrupter means to prevent a reverse flow of current flowing through said auxiliary winding.

2. An electronic ignition device for an internal combustion engine according to claim 1, wherein the number of turns of said auxiliary winding is one-half to one-fourth the number of turns of said primary winding.

3. An electronic ignition device for an internal combustion engine according to claim 1, wherein said second current interrupter means comprises a monostable multivibrator and a semiconductor switching means, said monostable multivibrator generating an output signal having a predetermined pulse width each time current flow through said primary winding is interrupted, said semiconductor switching means being rendered conductive to provide for said current flow path in response to said output signal from said monostable multivibrator.

4. An electronic ignition device for an internal combustion engine comprising:

an ignition coil having a core and primary and secondary windings, both wound about said core;

current interrupter means for alternately turning on and off current flow through said primary winding, thereby inducing a high voltage across said secondary winding upon the interruption of the current flow through said primary winding;

an auxiliary winding, having less turns than said primary winding, wound about said core of said ignition coil and connected to said primary winding;

semiconductor switching means for completing a current flow path for said auxiliary winding when energized, said current flow path causing magnetic flux to be generated through said core in a direction opposite to that of magnetic flux generated when said primary winding is energized;

a diode, provided in said current flow path and connected in series with said semiconductor switching means to prevent a reverse flow of current flowing through said auxiliary winding;

signal generating circuit means for generating, in synchronism with each interruption of the current flow through said primary winding, a monostable pulse signal, the pulse width of said monostable pulse signal being varied with engine rotational speed; and means for energizing said semiconductor switching means to pass current flowing through said auxiliary winding when said monostable pulse signal is available.

5. An electronic ignition device for an internal combustion engine according to claim 4, wherein said pulse width of said monostable pulse signal is shortened with increasing engine rotational speed.

6. An electronic ignition device for an internal combustion engine comprising:

an ignition coil having a core and primary and secondary windings, both wound about said core;

current interrupter means for alternately turning on and off current flow through said primary winding thereby inducing a high voltage across said secondary winding upon the interruption of the current flow through said primary winding;

an auxiliary winding, having less turns than said primary winding, wound about said core of said ignition coil and connected to said primary winding;

semiconductor switching means for completing a current flow path for said auxiliary winding by being energized upon the interruption of the current flow through said primary winding, said current flow path causing magnetic flux to be generated through said core in a direction opposite to that of magneitc flux generated when said primary winding is energized;

a diode, provided in said current flow path and connected in series with said semiconductor switching means to prevent a reverse flow of current flowing through said auxiliary winding; and discharge detecting circuit means, responsive to the magnitude of an arc-discharging current in the secondary circuit, for turning off said semiconductor switching means when said arc-discharging current substantially decreases to zero.

7. An electronic ignition device for an internal combustion engine according to claim 6, wherein said discharge detecting circuit means detects a voltage induced across said primary winding by said arc-discharging current.

8. An electonic ignition device for an internal combustion engine according to claim 7, wherein said discharge detecting circuit means comprises a comparator comparing a voltage value at a juncture between said primary winding and said current interrupter means with a set value being larger than the battery voltage and being smaller than said voltage induced across said primary winding, thereby producing a discharge detecting signal when said juncture voltage is above said set value, said semiconductor switching means being responsive to said discharge detecting signal.

9. An electronic ignition device for an internal combustion engine according to claim 6, wherein said discharge detecting circuit means comprises a resistor connected between one end of said secondary winding and ground, and a comparator comparing a voltage developed across said resistor with a predetermined set value larger than zero, said voltage taking its maximum value at the interruption of the current flow through said primary winding of said ignition coil, thereafter being decreased to zero, thereby producing a discharge detecting signal when said voltage is above said predetermined set value, said semiconductor switching means being responsive to said discharge detecting signal.

10. An electronic ignition device for an internal combustion engine comprising:

an ignition coil having a core and primary and secondary windings, both wound about said core;

current interrupter means for alternately turning on and off current flow through said primary winding, thereby inducing a high voltage across said secondary winding upon the interruption of the current flow through said primary winding;

an auxiliary winding, having less turns than said primary winding, wound about said core of said ignition coil and connected to said primary winding;

semiconductor switching means for completing a current flow path for said auxiliary winding when energized, said current flow path causing magnetic flux to be generated through said core in a direction opposite to that of magnetic flux generated when said primary winding is energized;

a diode, provided in said current flow path and connected in series with said semiconductor switching means to prevent a reverse flow of current flowing through said auxiliary winding;

signal generating circuit means for generating, in synchronism with each interruption of the current flow through said primary winding, a monostable pulse signal, the pulse width of said monostable pulse signal being varied with engine rotational speed;

discharge detecting circuit means for detecting whether an arc-discharging current is flowing through said secondary winding and generating a discharge detecting signal in the presence of said arc-discharging current; and logic circuit means, connected to said signal generating and discharge detecting circuit means, for energizing said semiconductor switching means to pass current flowing through said auxiliary winding when said monostable pulse signal and said discharge detecting signal both are available.

11. An electronic ignition device for an internal combustion engine according to claim 10, wherein said pulse width of said monostable pulse signal is shortened with increasing engine rotational speed.

12. An electronic ignition device for an internal combustion engine comprising:

an ignition coil having a core and primary and secondary windings, both wound about said core;

current interrupter means for alternately turning on and off current flow through said primary winding, thereby inducing a high voltage across said secondary winding upon the interruption of the current flow through said primary winding;

an auxiliary winding, having less turns than said primary winding, wound about said core of said ignition coil and connected to said primary winding;

semiconductor switching means for completing a current flow path for said auxiliary winding when energized, said current flow path causing magnetic flux to be generated through said core in a direction opposite to that of magnetic flux generated when said primary winding is energized;

a diode, provided in said current flow path and connected in series with said semiconductor switching means to prevent a reverse flow of current flowing through said auxiliary winding;

angular position detecting means for detecting a period from a cranking angular position at the interruption of the current flow through said primary winding to a predetermined cranking angular position near top dead center and generating an angular signal corresponding to said period;

discharge detecting circuit means for detecting whether an arc-discharging current is flowing through said secondary winding and generating a discharge detecting signal in the presence of said arc-discharging current; and logic circuit means, connected to said angular position detecting means and said discharge detecting circuit means, for energizing said semiconductor switching means to pass current flowing through said auxiliary winding when said angular signal and said discharge detecting signal both are available.

* * * * *